US009371768B2

(12) United States Patent
Yamanari et al.

(10) Patent No.: US 9,371,768 B2
(45) Date of Patent: Jun. 21, 2016

(54) EXHAUST SYSTEM MEMBER

(71) Applicants: Kenji Yamanari, Kariya (JP); Ryoji Tachibana, Toyota (JP); Keisuke Hatamura, Toyota (JP); Masayuki Kuno, Toyota (JP)

(72) Inventors: Kenji Yamanari, Kariya (JP); Ryoji Tachibana, Toyota (JP); Keisuke Hatamura, Toyota (JP); Masayuki Kuno, Toyota (JP)

(73) Assignees: TOYOTA JIDOSHA KABUSHIKI KAISHA, Toyota (JP); SANGO CO., LTD., Miyoshi (JP)

( * ) Notice: Subject to any disclaimer, the term of this patent is extended or adjusted under 35 U.S.C. 154(b) by 0 days.

(21) Appl. No.: 14/419,540

(22) PCT Filed: Sep. 24, 2013

(86) PCT No.: PCT/IB2013/002097
§ 371 (c)(1),
(2) Date: Feb. 4, 2015

(87) PCT Pub. No.: WO2014/053896
PCT Pub. Date: Apr. 10, 2014

(65) Prior Publication Data

US 2015/0204230 A1 Jul. 23, 2015

(30) Foreign Application Priority Data

Oct. 3, 2012 (JP) ..... 2012-221443

(51) Int. Cl.
*B60K 13/04* (2006.01)
*F01N 13/18* (2010.01)
*F01N 13/08* (2010.01)

(52) U.S. Cl.
CPC ..... *F01N 13/1888* (2013.01); *F01N 13/08* (2013.01); *F01N 13/1844* (2013.01); *F01N 13/1894* (2013.01); *F01N 2450/22* (2013.01)

(58) Field of Classification Search
CPC .. F01N 13/1888; F01N 13/08; F01N 13/1844
USPC ..... 180/309, 296
See application file for complete search history.

(56) References Cited

U.S. PATENT DOCUMENTS 2,173,399 A * 9/1939 Mills ..... F16L 55/178 138/99
2,262,627 A * 11/1941 Whitesell, Jr. ..... F01N 13/1805 138/157

(Continued)

FOREIGN PATENT DOCUMENTS

JP 2004-052715 A 2/2004
JP 2008-121550 A 5/2008

*Primary Examiner* — Hau Phan
(74) *Attorney, Agent, or Firm* — Oliff PLC

(57) ABSTRACT

An exhaust system member having an upstream-side opening into which exhaust gas flows and a downstream-side opening from which exhaust gas flows includes: first and second members. The first member includes first facing portions each having a distal end portion bulged radially outward in the exhaust system member, a notch is provided at a boundary between the distal end portion and a proximal end portion radially inward of the distal end portion at each end portion of each first facing portion, adjacent to the corresponding opening. The second member includes second facing portions, each arranged on the radially inner side of the corresponding distal end portion, each second facing portion is welded at a portion overlapped with the corresponding first facing portion, and a distal end face of each second facing portion facing a proximal end-side notch face of the notch in the corresponding first facing portion.

2 Claims, 4 Drawing Sheets

(56) References Cited

U.S. PATENT DOCUMENTS 3,771,820 A * 11/1973 Hoss, Sr. ..... F16L 13/103 285/373
5,358,283 A * 10/1994 Silva ..... F16L 21/06 285/24
5,508,478 A * 4/1996 Barry ..... F01N 13/08 180/309
5,722,463 A * 3/1998 Smyth ..... F16L 55/175 138/158
7,066,210 B2 * 6/2006 Kakoschke ..... F16L 55/172 138/167
7,325,651 B2 * 2/2008 Kikuchi ..... F01N 1/089 180/296
2006/0284413 A1 * 12/2006 Barrera ..... F16L 55/17 285/15
2007/0222217 A1 * 9/2007 Bennett ..... F16L 25/12 285/373
2010/0005789 A1 1/2010 Moritsugu

* cited by examiner

EXHAUST SYSTEM MEMBER

BACKGROUND OF THE INVENTION

1. Field of the Invention

The invention relates to an exhaust system member that constitutes a passage through which exhaust gas emitted from a combustion chamber of an internal combustion engine flows.

2. Description of Related Art

There is known an example of an exhaust system member of this type, which is formed of a pair of members each having a semicircular cross-sectional shape. These members are connected to each other by welding the facing portions of the members. FIG. 5 is a view that shows an example of such an exhaust system member 100. As shown in FIG. 5, a first facing portion 112 of a first member 111 bulges radially outward of the exhaust system member 100. A second facing portion 122 of a second member 121 is located at a radially inner side of the exhaust system member 100 with respect to the first facing portion 112. Overlapped portions of these first facing portion 112 and second facing portion 122 are welded overall along an axial direction of the exhaust system member 100. Thus, the first member 111 and the second member 121 are integrated with each other.

A cylindrical member is inserted into the exhaust system member 100 through an opening 101, and coupled portions of the cylindrical member and exhaust system member are welded to each other all around along an end portion of the exhaust system member 100. In the example of FIG. 5, relatively large gaps 102 are formed at the opening 101 of the exhaust system member 100 between the first member 111 and the second member 121. Therefore, at the time of welding the cylindrical member to the exhaust system member, a spatter that is produced through the welding may enter the inside of the exhaust system member 100 via the gaps 102.

There is suggested a member described in Japanese Patent Application Publication No. 2008-121550 (JP 2008-121550 A) as an exhaust system member that is able to inhibit entry of such a spatter. That is, as shown in FIG. 6, in the first facing portions 212 of the first member 211, portions other than both ends adjacent to the opening of the exhaust system member 200 serve as bulged portions 213 that bulge radially outward. On the other hand, the second facing portions 222 of the second member 221 have protruding portions 223 at locations corresponding to the bulged portions 213.

As shown in FIG. 7, the protruding portions 223 are located radially inward of the bulged portions 213 when the second member 221 is assembled to the first member 211 and then the first facing portions 212 and the second facing portions 222 are welded to each other. Thus, near the opening 201 of the exhaust system member 200, the end faces of the second facing portions 222 match the end faces of the first facing portions 212. Therefore, it is possible to narrow the gaps as shown in FIG. 5, formed at the opening 201 of the exhaust system member 200. As a result, a spatter, which is produced at the time when the cylindrical member 250 is inserted into the exhaust system member 200 through the opening 201 and then the coupled portions are welded to each other, is hard to enter the inside of the exhaust system member 200 by the narrowed amounts of the gaps.

However, in terms of manufacturing tolerances, assembling tolerances, and the like, of the first member 211 and the second member 221, it is difficult to completely eliminate the above-described gaps. Therefore, at the time of welding the first facing portions 212 and the second facing portions 222 overall along the axial direction, a spatter may enter the inside through the gaps.

SUMMARY OF THE INVENTION

The invention provides an exhaust system member that is able to inhibit entry of a spatter, which is produced at the time of welding the facing portions of members to each other, and a spatter, which is produced at the time of welding another member to an opening, to the inside of the exhaust system member.

A first aspect of the invention provides an exhaust system member having an upstream-side opening into which exhaust gas flows and a downstream-side opening from which exhaust gas flows. The exhaust system member includes a first member and a second member. The first member includes first facing portions, each first facing portion including a distal end portion and a proximal end portion. The distal end portion is bulged radially outward in the exhaust system member. The proximal end portion located on the radially inner side of the distal end portion. A notch is provided at a boundary between the distal end portion and a proximal end portion at each end portion of each first facing portion, adjacent to the corresponding opening. The second member includes second facing portions, each second facing portion is arranged on the radially inner side of the corresponding distal end portion, each second facing portion is welded to the corresponding first facing portion at a portion overlapped with the corresponding first facing portion, a distal end face of each second facing portion faces a proximal end-side notch face of the notch in the corresponding first facing portion.

With the above configuration, the facing portions of the first member and second member are overlapped overall, and the overlapped portions are welded to each other. Therefore, it is possible to inhibit entry of a spatter, which is produced at the time of welding the facing portions of the first member and second member, into the exhaust system member.

The notch for cutting each distal end portion located at the outer side off from the corresponding proximal end portion located on the inner side of the distal end portion is provided at each end portion of each first facing portion, adjacent to the corresponding opening, and the proximal end side of each notch is located on the inner side of the distal end side of the notch. Thus, it is possible to match the proximal end-side notch face of each notch with the distal end face of the corresponding second facing portion. Thus, it is possible to narrow the gaps formed at these portions, and it is possible to inhibit entry of a spatter, which is produced at the time of welding another member to one of the openings, into the exhaust system member.

In the exhaust system member, another exhaust system member may be fitted and coupled to an end portion of the exhaust system member.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
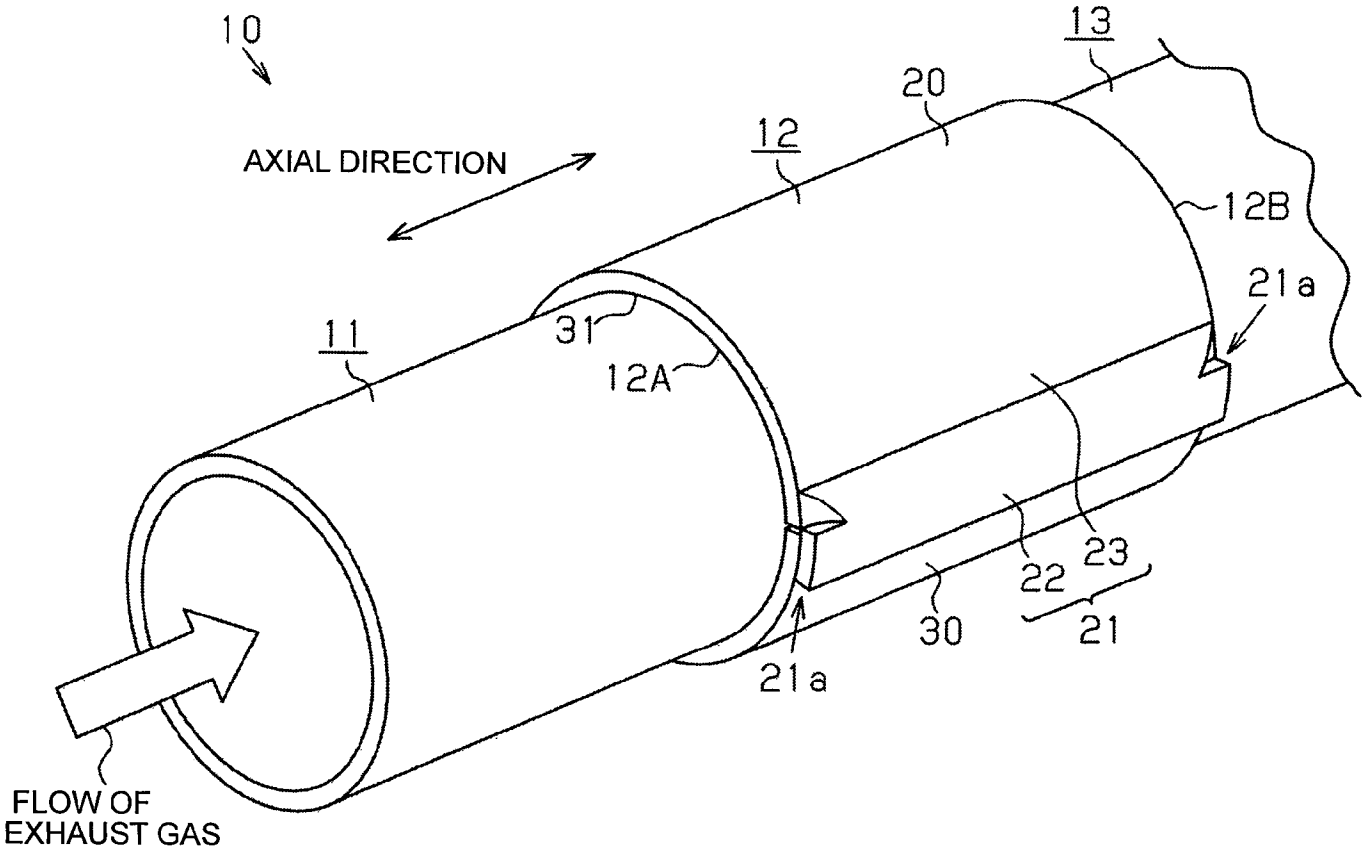
FIG. 1 is a perspective view that schematically shows an exhaust pipe according to an embodiment of the invention.

Hereinafter, an example embodiment of the invention will be described with reference to FIG. 1 to FIG. 4. As shown in FIG. 1, an exhaust pipe 10 includes a plurality of exhaust system member, that is a first exhaust system member 11, a second exhaust system member 12 and a third exhaust system member 13 arranged sequentially from an exhaust gas upstream side. Exhaust gas emitted from a combustion chamber of an internal combustion engine flows through the exhaust pipe 10. The first exhaust system member 11 has a cylindrical shape. An exhaust gas downstream-side end portion of the first exhaust system member 11 is inserted in the second exhaust system member 12 via an exhaust gas upstream-side opening 12A. Coupled portions of the first exhaust system member 11 and second exhaust system member 12 are welded to each other along the circumferential direction. Similarly, the third exhaust system member 13 has a cylindrical shape, and its upstream-side end portion is inserted in the second exhaust system member 12 via an exhaust gas downstream-side opening 12B. Coupled portions of the second exhaust system member 12 and third exhaust system member 13 are welded to each other along the circumferential direction. In the present embodiment, a direction in which the plurality of exhaust system members 11 to 13 are arranged is termed "axial direction".

Figure 2:
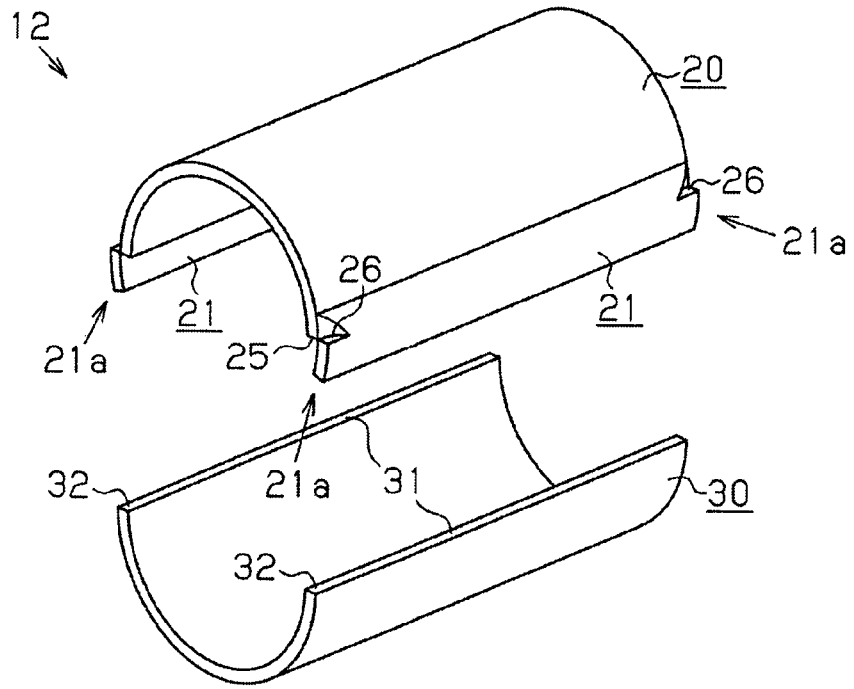
FIG. 2 is an exploded perspective view of a second exhaust system member according to the embodiment.
Figure 3:
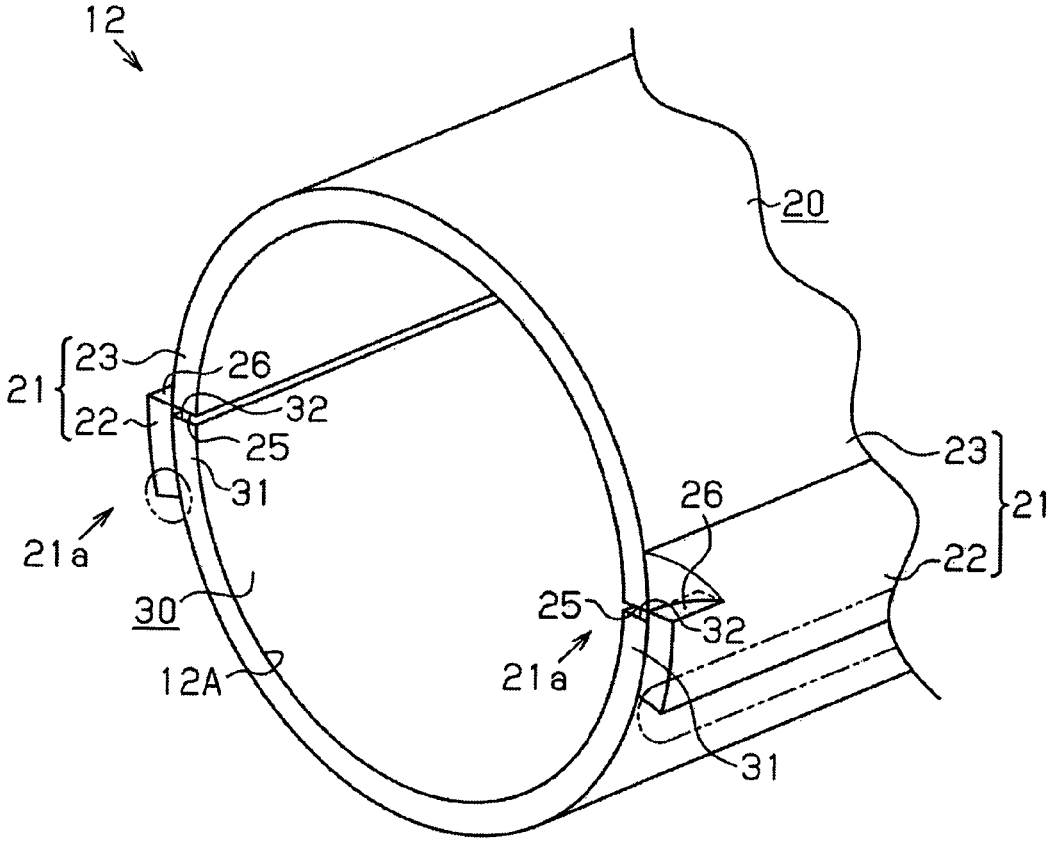
FIG. 3 is a perspective view of part of the second exhaust system member according to the embodiment.

As shown in FIG. 1 to FIG. 3, the second exhaust system member 12 includes a first member 20 and a second member 30 that cooperatively form the upstream-side opening 12A into which exhaust gas flows and the downstream-side opening 12B from which exhaust gas flows. These members 20, 30 each have a substantially circular arc shape in plan view when viewed in the axial direction. By assembling the members 20, 30 to each other, the second exhaust system member 12 having a cylindrical shape is formed.

Both circumferential ends of the first member 20 and both circumferential ends of the second member 30 respectively face each other. In the present embodiment, both circumferential ends of the first member 20 are termed "first facing portions 21". In addition, both circumferential ends of the second member 30 are termed "second facing portions 31".

These first facing portions 21 have such a shape that respective distal end portions 22 are bulged radially outward of the first member 20 (or the second exhaust system member 12) having a circular arc shape. Both axial end portions 21*a* of each first facing portion 21 are respectively adjacent to the openings 12A, 12B of the second exhaust system member 12. Lancing is applied to both end portions 21*a*. That is, at each end portion 21*a* of each first facing portion 21, a notch is formed at the boundary between the distal end portion 22 and a proximal end portion 23 located radially inward of the distal end portion 22. Each end portion 21*a* of each first facing portion 21 is formed such that a proximal end-side notch face 25 of the notch is located on the radially inner side of a distal end-side notch face 26.

At the time of assembling the second member 30 to the first member 20, the second facing portions 31 are respectively arranged on the radially inner side of the first facing portions 21 (specifically, the distal end portions 22 of the first facing portions 21). The proximal end-side notch faces 25 of the notches respectively formed at the end portions 21*a* of each first facing portion 21 are caused to match a corresponding circumferentially facing distal end face 32 at both axial end portions of each second facing portion 31. That is, each proximal end-side notch face 25 faces corresponding distal end face 32. In this state, at the locations indicated by the alternate long and two-short dashed lines in FIG. 3, overlapped portions of the pairs of first facing portion 21 and second facing portion 31 are welded to each other overall along the axial direction. Thus, the first member 20 and the second member 30 are integrated with each other.

Next, an example of a manufacturing method for the exhaust pipe 10 will be described with reference to FIG. 4. The second member 30 is assembled to the first member 20 such that the second facing portions 31 are respectively located on the radially inner side of the first facing portions 21. Thus, the first facing portions 21 and the second facing portions 31 respectively overlap each other overall along the axial direction of the exhaust system member. As a result, the overlapped portions of these pairs of facing portions are welded to each other overall along the axial direction.

Figure 4:
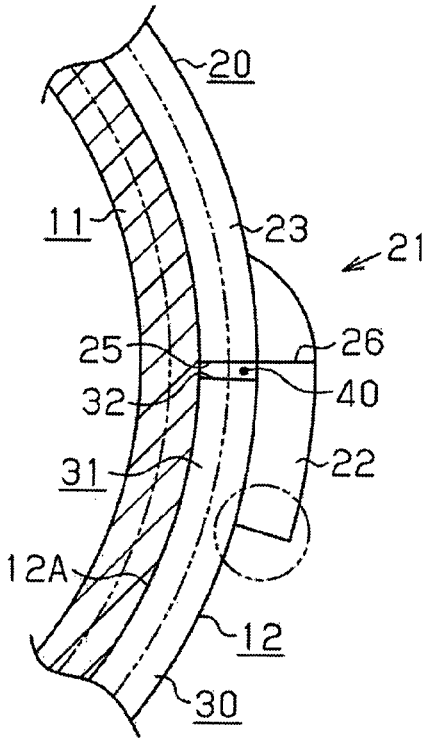
FIG. 4 is a partially enlarged view that shows a state where a first exhaust system member is coupled to the second exhaust system member according to the embodiment.

At this time, as shown in FIG. 4, a slight gap 40 may be formed between each proximal end-side notch face 25 formed at each end portion 21*a* of each first facing portion 21 and the corresponding distal end face 32 of each axial end portion of the corresponding second facing portion 31. Each gap 40 may be formed on the basis of the relationship, such as manufacturing tolerances, assembling tolerances, and the like, of the members 20, 30. However, according to the present embodiment, each gap 40 is covered with the corresponding first facing portion 21 when the second exhaust system member 12 is viewed from the outer side. Therefore, a spatter that is produced at the time of welding the members 20, 30 to each other is almost hard to enter the inside of the second exhaust system member 12 via the gaps 40. As a result, a process for removing a spatter entering the inside of the second exhaust system member 12 is omitted or the process is significantly reduced in time.

When the first exhaust system member 11 is coupled to the thus configured second exhaust system member 12, the downstream end of the first exhaust system member 11 is fitted to the second exhaust system member 12 via the upstream-side opening 12A. In this state, the coupled portions of the first exhaust system member 11 and second exhaust system member 12 are welded to each other overall along the circumferential direction at the locations indicated by the alternate long and two-short dashed lines in FIG. 4. As a result, the downstream end of the first exhaust system member 11 is connected to the upstream end of the second exhaust system member 12.

Figure 5:
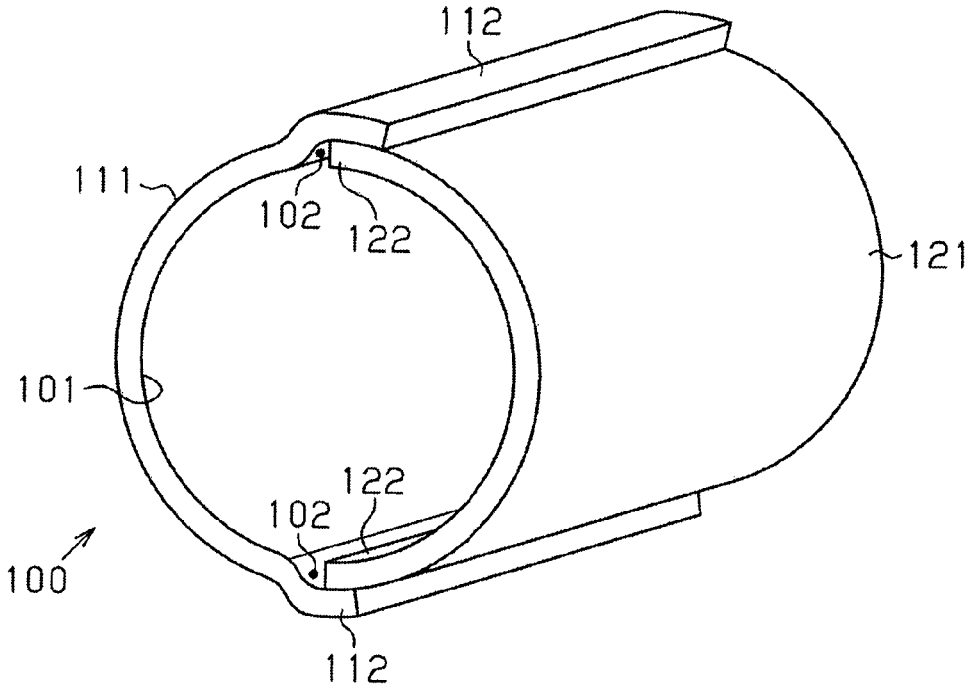
FIG. 5 RELATED ART
FIG. 5 is a perspective view that shows a first related art.
Figure 6:
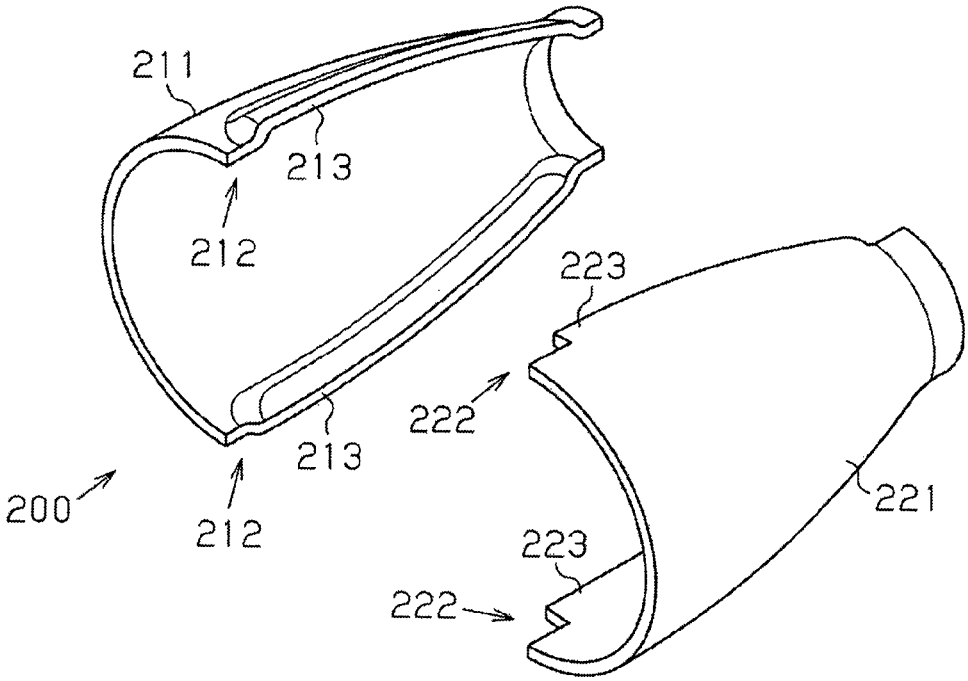
FIG. 6 RELATED ART
FIG. 6 is a perspective view that shows a second related art.
Figure 7:
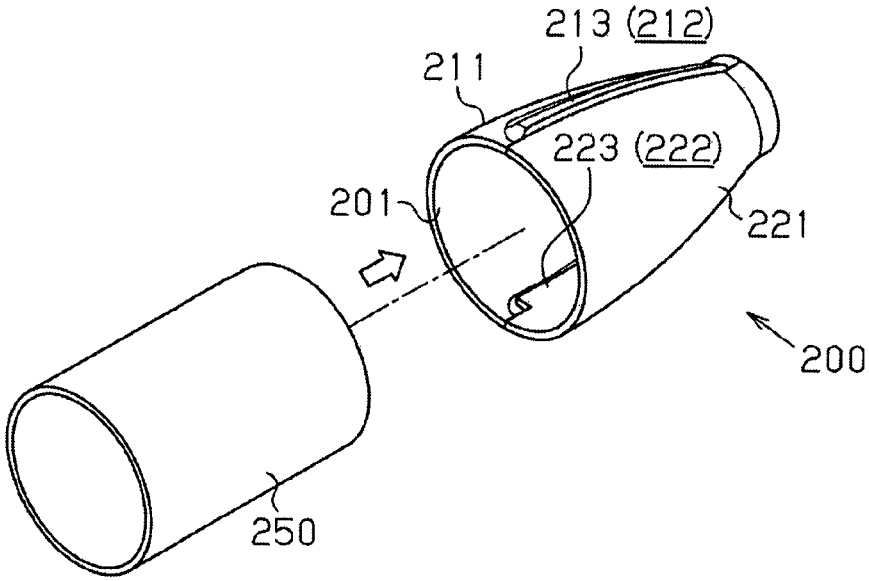
FIG. 7 RELATED ART
FIG. 7 is a perspective view that shows the second related art.

A spatter that is produced at the time of such welding may attempt to enter the gaps 40. However, the gaps 40 in the present embodiment are considerably narrower than the gaps 102 according to the first related art shown in FIG. 5. Therefore, a spatter that is produced at the time of welding the exhaust system members 11, 12 to each other is hard to enter the inside of the second exhaust system member 12 by the narrowed amount of the gaps 40. As a result, a process for removing a spatter entering the inside of the first and second exhaust system members 11, 12 is omitted or the process is significantly reduced in time.

A process of coupling the third exhaust system member 13 to the second exhaust system member 12 is similar to the process of coupling the first exhaust system member 11 to the second exhaust system member 12. Therefore, here, the description of the process of coupling the third exhaust system member 13 to the second exhaust system member 12 is omitted.

As described above, in the present embodiment, the following advantageous effects are obtained. At the time of assembling the exhaust system members 11, 12, the first facing portions 21 and the second facing portions 31 are respectively overlapped overall along the axial direction, and the overlapped portions are welded to each other. Therefore, it is possible to inhibit entry of a spatter, which is produced at the time of welding the first facing portions 21 and the second facing portions 31 to each other, into the second exhaust system member 12.

Each notch for cutting each distal end portion 22 located at the radially outer side of the first member 20 (or the second exhaust system member 12) having a circular arc shape off from the corresponding proximal end portion 23 located on the radially inner side of the distal end portion 22 is provided at each end portion 21*a* of each first facing portion 21. The proximal end side of each notch is arranged on the inner side of the distal end side. Thus, it is possible to match the proximal end-side notch face 25 of each notch with the distal end face 32 of the corresponding second facing portion 31. Thus, it is possible to extremely narrow the gap 40 formed at this portion, and it is possible to inhibit entry of a spatter, which is produced at the time of welding another member to one of the openings 12A, 12B, into the second exhaust system member 12.

The invention is not limited to the above-described embodiment; the invention may be implemented in the following alternative embodiments. Each of the exhaust system members 11 to 13 may have another selected shape (for example, a rectangular tubular shape) other than the cylindrical shape as long as each of the exhaust system members 11 to 13 is a tubular member.

At least one of the first to third exhaust system members 11 to 13 may be configured such that a catalyst is accommodated inside the at least one of the first to third exhaust system members 11 to 13.

The invention claimed is:

1. An exhaust system member having an upstream-side opening into which exhaust gas flows and a downstream-side opening from which exhaust gas flows, the exhaust system member comprising:

a first member and a second member that cooperatively form the upstream-side opening and the downstream-side opening, the first member including first facing portions;

each first facing portion including a distal end portion and a proximal end portion;

the distal end portion being bulged radially outward in the exhaust system member;

the proximal end portion being located on the radially inner side of the distal end portion;

a notch for cutting the distal end portion being provided at a boundary between the distal end portion and the proximal end portion at each end portion of each first facing portion, adjacent to the corresponding opening, wherein a proximal end side of each notch is located on an inner side of a distal end side of the notch; and the second member including second facing portions;

each second facing portion being arranged on the radially inner side of the corresponding distal end portion;

each second facing portion being welded to the corresponding first facing portion at a portion overlapped with the corresponding first facing portion, and a distal end face of each second facing portion facing a proximal end-side notch face of the notch in the corresponding first facing portion, wherein the proximal end-side notch faces of the notches respectively formed at the end portions of each first facing portion are caused to match a corresponding circumferentially facing distal end face at both axial end portions of each second facing portion, wherein overlapped portions of a pair of the first facing portion and the second facing portion are welded to each other overall along an axial direction.

2. The exhaust system member according to claim 1, wherein another exhaust system member is fitted and coupled to an end portion of the exhaust system member.

* * * * *